US009756690B2

(12) United States Patent
Stefanoff et al.

(10) Patent No.: US 9,756,690 B2
(45) Date of Patent: Sep. 5, 2017

(54) LED CAUTION LIGHTING SYSTEM

(76) Inventors: Buddy A. Stefanoff, Collinsville, OK (US); Dana D. Stefanoff, Collinsville, OK (US)

( * ) Notice: Subject to any disclaimer, the term of this patent is extended or adjusted under 35 U.S.C. 154(b) by 748 days.

(21) Appl. No.: 13/486,835

(22) Filed: Jun. 1, 2012

(65) Prior Publication Data

US 2012/0306385 A1 Dec. 6, 2012

Related U.S. Application Data

(60) Provisional application No. 61/492,150, filed on Jun. 1, 2011.

(51) Int. Cl.
*H05B 37/02* (2006.01)
*H05B 33/08* (2006.01)

(52) U.S. Cl.
CPC ..... *H05B 33/0818* (2013.01); *H05B 33/086* (2013.01); *H05B 33/0827* (2013.01)

(58) Field of Classification Search
CPC ..... H05B 33/0803; H05B 33/0848; H05B 33/0815; H05B 33/0818; H05B 37/029; H05B 41/3925; H05B 41/2828; G01D 7/005
USPC ..... 315/161
See application file for complete search history.

(56) References Cited

U.S. PATENT DOCUMENTS

| | | | | |
|---|---|---|---|---|
| 7,495,397 | B2 * | 2/2009 | Okabe | 315/169.1 |
| 2002/0195975 | A1 * | 12/2002 | Schanberger et al. | 315/291 |
| 2003/0016190 | A1 * | 1/2003 | Kondo | G09G 3/3258 345/55 |
| 2008/0122764 | A1 * | 5/2008 | Huang et al. | 345/83 |
| 2009/0021955 | A1 * | 1/2009 | Kuang et al. | 362/479 |
| 2009/0121651 | A1 * | 5/2009 | Gandhi | 315/291 |
| 2009/0267540 | A1 * | 10/2009 | Chemel et al. | 315/297 |
| 2010/0102734 | A1 * | 4/2010 | Quick et al. | 315/185 R |
| 2011/0109228 | A1 * | 5/2011 | Shimomura | H05B 37/0245 315/113 |
| 2011/0285294 | A1 * | 11/2011 | Hansler et al. | 315/152 |

OTHER PUBLICATIONS

Smart Technologies, Inc. Technical Bulletin, Issue 6, Feb. 19, 2001.*
Smart Technologies, Inc., User's Guide 'SMART Board Software' 2004.*

* cited by examiner

*Primary Examiner* — Alexander H Taningco
*Assistant Examiner* — Seokjin Kim
(74) *Attorney, Agent, or Firm* — John M. Behles

(57) ABSTRACT

A lighting indicator system having a controller with an analog output signal and an LED array receiving the analog output signal and lighting a plurality of LEDs in response. The LED array provides a second analog output that echoes the received analog output signal from the controller.

15 Claims, 3 Drawing Sheets

LED CAUTION LIGHTING SYSTEM

CROSS REFERENCE TO RELATED APPLICATIONS

This application claims the priority of U.S. Provisional Patent Application No. 61/492,150 entitled "LED CAUTION LIGHTING SYSTEM," filed Jun. 1, 2011, the contents of which are hereby incorporated by reference.

FIELD OF THE INVENTION

This disclosure relates to LED systems in general and, more specifically, to LED caution lighting systems for racetracks.

BACKGROUND OF THE INVENTION

Current caution lighting systems used by racetracks employ a number of (4 or more) flashing amber bulbs mounted at the corners or intersections of the racetracks. While they are visible to the racing driver, they are difficult to see by the race spectators. Spectators are usually only aware of a caution flag incident after the race cars have slowed to a pace speed.

Current systems also utilize incandescent bulbs. Incandescent bulbs are known to utilize a relatively large amount of power for the light they produce. A large portion of the energy consumed is wasted in generating heat. Additionally, incandescent bulbs have a relatively short service life, requiring frequent replacement.

Current caution light systems are generally arranged in a standard series or parallel circuit configuration. Expanding or modifying the system may require extensive rewiring, from the power supply through the whole circuit. For this reason, current caution lighting systems are generally directed only to drivers, with spectators being only a secondary consideration.

What is needed is a system and method for addressing the above and related issues.

SUMMARY OF THE INVENTION

The invention of the present disclosure, in one aspect thereof, comprises a lighting indicator system having a controller with an analog output signal and an LED array receiving the analog output signal and lighting a plurality of LEDs in response. The LED array provides a second analog output that echoes the received analog output signal from the controller. In some embodiments, the controller may be a programmable microcontroller.

In some embodiments, the analog output signal comprises a plurality of signals indicative of a plurality of colors for selective display on the LED array. The system may include a second LED array receiving the analog output signal from the first LED array and lighting a plurality of LEDs in response. The first LED array and the second LED array may be attached to separate power supplies.

The invention of the present disclosure, in another aspect thereof, comprises a signaling system having a controller that accepts user input and provides an electronic analog output signal. The system includes a first multicolor indicator that provides a visual signal of a first color in response to a first predetermined signal from the controller. The multicolor indicator provides an electronic analog output signal that echoes the predetermined signal from the controller.

In some embodiments, the system further comprises a second multicolor indicator that receives the echoed signal from the first multicolor indicator, provides a visual signal of the first color in response to the received signal, and echoes the received signal on an electronic analog output signal. The first and second multicolor indicators may provide visual signals of a second color in response to a second predetermined signal from the controller. The multicolor indicators comprise light emitting diodes (LED) arrays and the LED arrays may provide a plurality of LED colors. The controller may provide an electronic analog output signal corresponding to each of the plurality of LED colors to the multicolor indicators.

In some cases, the multicolor indicators each have a separate power supply that powers each associated LED array. The controller may have a power supply separate from the multicolor indicators. The LED arrays may be arranged as a flat panel of individual LEDs for providing a high visibility signal to a large audience. The LED arrays may be arranged to provide racing signals to spectators at a racetrack.

The invention of the present disclosure, in another aspect thereof, comprises light emitting diode (LED) signaling system. The system comprises a first LED signal panel that has a first power supply, an LED of a first color, and an LED of a second color. The system has a first analog input corresponding to the LED of the first color, a second analog input lead corresponding to the LED of the second color, a first analog output lead corresponding to the first color, and a second analog output lead corresponding to the second color. The first LED signal panel utilizes the first power supply to drive the LED of the first color at an intensity according to the first analog input and to drive the LED of the second color at an intensity according to the second analog input. The first LED signal panel echoes the first and second analog inputs to the first and second analog outputs, respectively.

In some embodiments, the system also comprises a second LED signal panel having a second power supply, an LED of the first color, and an LED of the second color. The panel has first analog input corresponding to the LED of the first color, a second analog input lead corresponding to the LED of the second color, a first analog output lead corresponding to the first color, and a second analog output lead corresponding to the second color. The second LED signal panel utilizes the second power supply to drive the LED of the first color at an intensity according to the first analog input and to drive the LED of the second color at an intensity according to the second analog input. The second LED signal panel echoes the first and second analog inputs to the first and second analog outputs, respectively. The analog outputs of the first LED signal panel may be electrically connected to the corresponding analog inputs of the second LED signal panel.

In some embodiments, the system includes controller having a third power supply and electrically connected to the analog inputs of the first LED signal panel. The controller may accept user inputs and generate corresponding analog output control signals for the first LED signal panel. The first and second LED signal panels may be installed proximate a racetrack to be visible to a spectator and may be capable of generating at least visible yellow and green lighting.

DETAILED DESCRIPTION OF THE PREFERRED EMBODIMENTS

Figure 1:
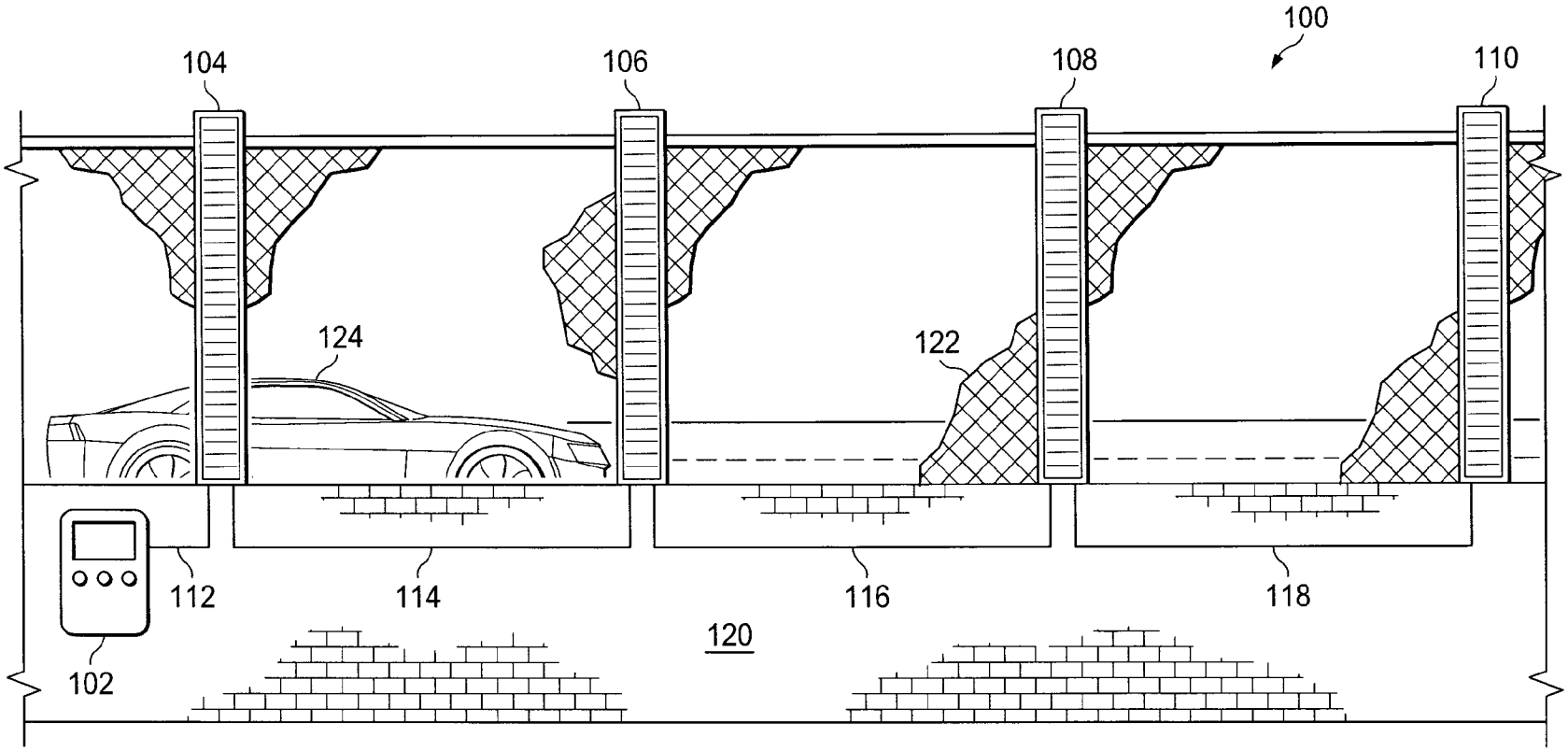
FIG. 1 is a perspective view of a scaled down example of the LED caution light system of the present disclosure.

Referring now to FIG. 1, a perspective view of a scaled down example of the LED caution light system 100 of the present disclosure is shown. In various embodiment of the present disclosure, a light emitting diode (LED) based caution lighting system 100 comprises a number of linear LED arrays 104, 106, 108, 110 mounted either vertically or horizontally along structures common to raceway facilities (i.e., "catch fence," "spectator fence," speaker pole mounts, etc.). Here the LED arrays are shown mounted on a racetrack catch fence 122 for high visibility from the point of view of the spectators.

The LED linear arrays 104, 106, 108, 110 are controlled by a master/slave configuration as explained in more detail below. The system 100 is designed to generate at least red, blue, green, white and amber colors that reflect the various stages/readiness of the track, the raceway and its facilities. The system is designed to enhance the safety of the facility and the track while adding to the experience and excitement of racing that is perceived by the fans/participants.

In one embodiment, the system 100 differs from traditional systems in that it is primarily designed to be viewed by the spectators/racing fans. In some respects, the system 100 transforms the catch fence 122 into a caution light indicator not only for the spectators but also racing officials and media personnel.

The system 100 includes a "master" controller 102 that sends analog signals to a series of "slave" controllers that are associated with each of the LED arrays or signal panels 104, 106, 108, 110. As explained in greater detail below, each "slave" controller comprises analog components that receive the signals from the "master" controller which, in turn, channels voltage and current from a locally-mounted power supply (1 power supply per "slave" controller) to the LED array 104, 106, 108, 110 mounted vertically or horizontally along the track fence 122 line. Each "slave" controller then retransmits the original signal sent from the "master" controller to the next "slave" controller in succession. Using this method, an infinite number of "slave" controllers can be interconnected allowing for extremely long circuit installations of a mile or more. Thus, the system of FIG. 1 is described as having been "scaled down" in that only four signal panels 104, 106, 108, 110 are shown.

In some embodiments the master controller 102 comprises a digital microprocessor that runs a series of software routines designed to generate various flashing, chasing and fading illumination effects. These digital commands that are then translated into a zero to 12-volt analog signal that is sent to the "slave" controllers for execution.

The embodiment of FIG. 1 includes a master controller 102 that connects to a plurality of LED arrays, shown as 104, 106, 108, and 110. It can be seen that the LED arrays 104, 106, 108, 110 are connected in a master-slave relationship. The master controller 102 provides analog signals via signal line 112 to the first LED array 104. The LED array 104 provides analog signals to the second LED array 106 via signal line 114. Similarly, LED array 106 signals LED array 108 via analog line 116; and LED array 108 signals LED array 110 via analog line 118.

It will be appreciated that the LED arrays 104, 106, 108, 110 may contain one or more colors of LEDs and that each of these may be individually controlled. Each LED array 104, 106, 108, 110 may connect to a separate power supply and rely on the upstream LED array only for signaling purposes. It is understood that any number of LED arrays could be added to the present configuration in order to extend the useful size of the system 100.

The present system 100 is utilized in a racetrack configuration with the arrays 104, 106, 108, 110 mounted along a wall 120 and forming a portion of a catch fence 122. However, the system 100 could be adapted to other uses, including non-race related uses. The viewpoint of FIG. 1 would approximate the view seen by a spectator of the race. A car 124 is shown for illustration purposes behind the wall 122. As described, a race spectator may be able to view the LED arrays 104, 106, 108, 110 and determine the current condition of the racetrack. This could include green flags, caution flags, checkered flags, or other race information.

Figure 2:
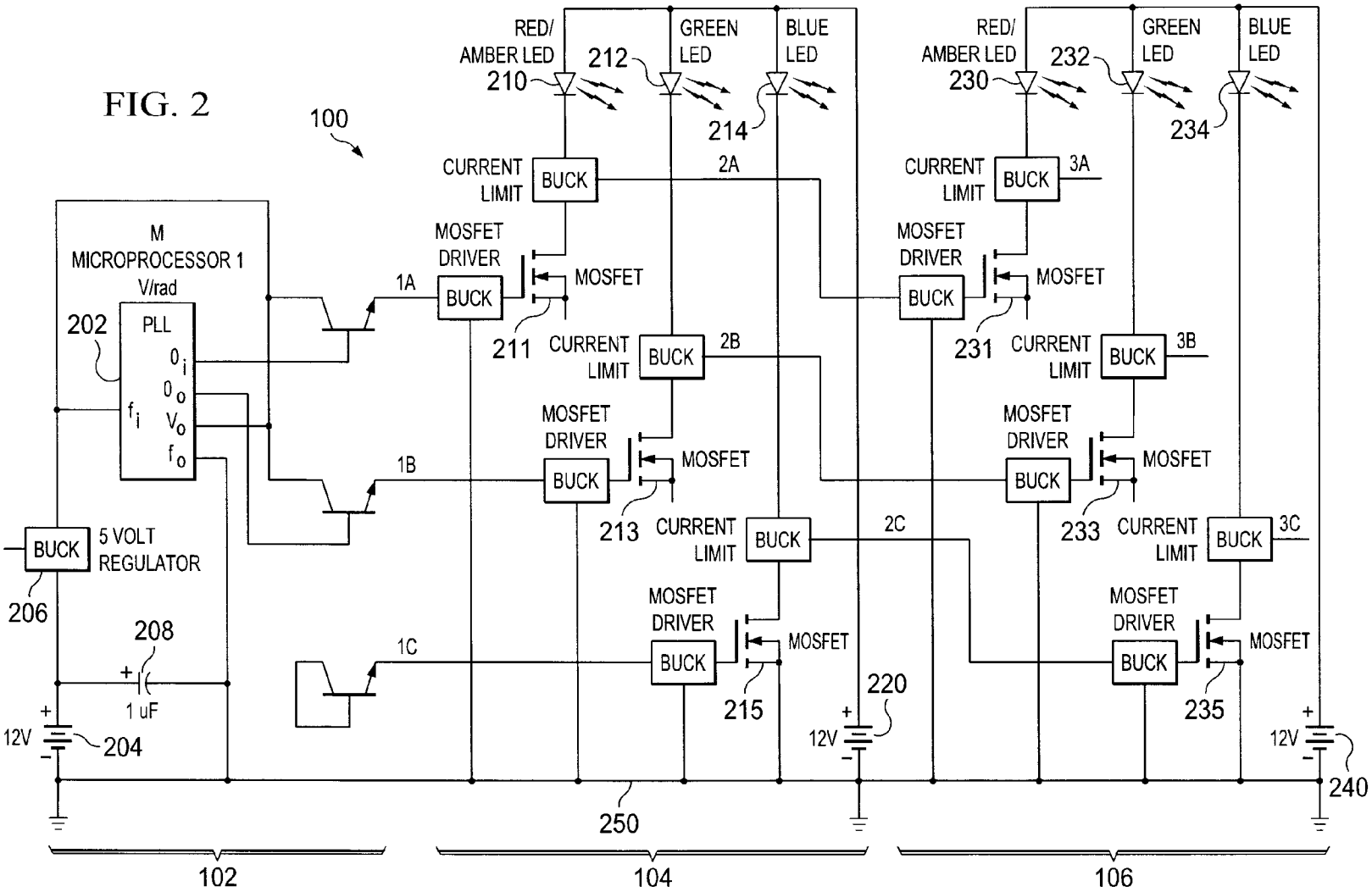
FIG. 2 is a schematic diagram of an embodiment of the LED caution light system of the present disclosure.

Referring now to FIG. 2, a schematic diagram of one embodiment of the LED caution light system 100 of the present disclosure is shown. From FIG. 2, it can be seen that the master controller 102 may comprise a microprocessor 202 connected to a 12 volt power supply 204 through a 5-volt voltage regulator 206 and appropriate grounding capacitors 208. Inputs to the microprocessor may be controlled by buttons, switch gears, key pads, and/or other devices.

In the present embodiment, the microcontroller 102 can control up to three different colors of LEDs. In the present embodiment, a red or amber LED control is provided on signal line 1A, a green LED control line is provided on line 1B, and a blue LED control line is provided on line 1C. Each of these signal lines passes to the first LED array 104. It is understood that in other embodiments more or fewer LED colors could be controlled by having more or fewer analog signal lines. It is also understood that more than three visible colors may be produced on the associated LED array by combining various brightness levels of the three discrete LED colors. Therefore in some embodiments, the intensity or brightness of each discrete LED color may controlled by a corresponding voltage on the associated control lines 1A, 1B, 1C. In other embodiments, the LEDs could be activated in a binary fashion (e.g., the associated LED colors are either on, or off).

The configuration of FIG. 2 illustrates one possible way that the LED array 104 can be configured in the master-slave relationship. The outputs from the controller 1A, 1B, 1C, provide the inputs to the array 104. The LED array 104 attaches to its own separate 12-volt power supply 220 and provides a number of red/amber 210, green 212, and blue 214 LEDs. These may be separately signaled by the control lines 1A, 1B, and 1C coming from the controller 102. Current limiters and drivers 211, 213, 215 may be connected between the LEDs 210, 212, and 214, respectively and a common ground 250 to activate or deactivate the LEDs in response to analog signals from the input lines 1A, 1B, and 1C. It is understood that each device in FIG. 2 is need not necessarily be connected to the same physical ground, so long as each ground is sufficiently close to zero volts. It can also be seen that whatever input is received via signal lines 1A, 1B, and 1C may be output from the LED array 104 on output lines 2A, 2B, and 2C. In the present embodiment, the output signal lines for the red, green and blue LEDs 210, 212, 214 correspond to the input signals 1A, 1B, and 1C, respectively.

In FIG. 2, a second LED array 106 is shown that is substantially similar to the first LED array 104 except that the LED array 106 accepts analog control inputs from the output of the first array 104. Thus the outputs 2A, 2B, and 2C from the first array 104 are provided as inputs to the second array 106. The array 106 also is attached to its own separate power supply 240 such that the only connection between the array 106 and the array 104 are the signal lines 2A, 2B, and 2C corresponding to the respective LED colors. This configuration allows the arrays 104, 106 to be installed at arbitrarily large distances from one another so long as each array has access to a 12 volt power supply. Although only two arrays 104, 106 are shown in the present example, it is understood array 106 could be used to output analog signals to additional arrays. It will also be appreciated that due to the master-slave configuration, the entire set of LED arrays can be controlled by a single control unit 102. The control unit 102 may be digitally programmed to provide the desired effects and color combinations for the LED arrays of the system.

The second array 106 (as well as any others that are "downstream") may have a similar electronic configuration as the first array 104. For example, current limiters and drivers 231, 233, 235 may be connected between the LEDs 230, 232, and 234, respectively, and a common ground 250 to activate or deactivate the LEDs in response to analog signals from the input lines 1A, 1B, and 1C.

It is understood to those having skill in the art that the particular circuitry configuration of the arrays 104, 106 of FIG. 1 is only one way that LEDs may be attached and driven. Thus, the present disclosure is not meant to be limited only to the particular embodiments of circuitry shown.

Figure 3:
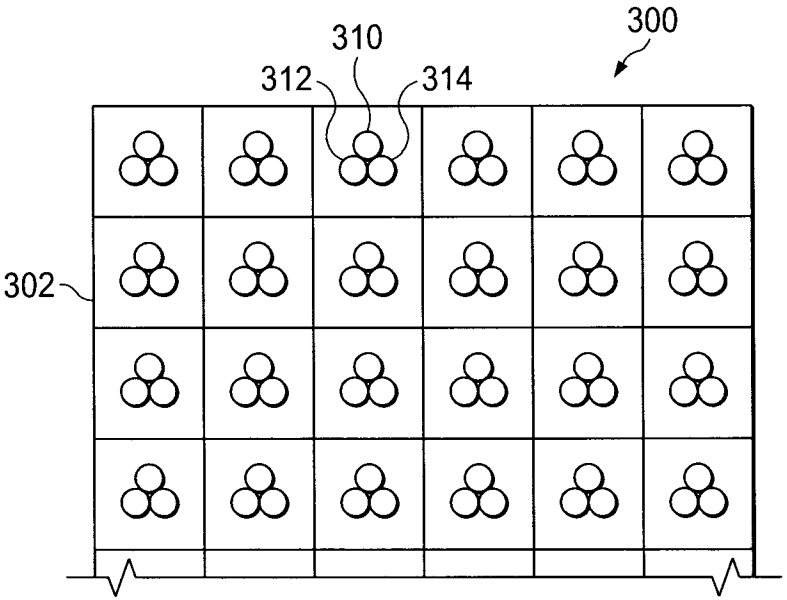
FIG. 3 is a close-up view of an LED signal panel according to the present disclosure.

Referring now to FIG. 3, a close-up view of an LED signal panel 300 according to the present disclosure. The panel 300 may provide the actual lighting or signaling mechanism corresponding to an LED array (such as array 104 or array 106 of FIG. 2). Here it can be appreciated that, although only a single color of each LED is shown for each array 104, 106 in FIG. 2, in practice, a plurality of each LED color may be provided on a signal panel 300 corresponding to an LED array. In some embodiments, the panel 300 may be considered as comprising a number of pixels 302. Each pixel 302 may have one or more of each color of LED in relatively close proximity. In this manner, various intensities of LED brightness can be combined to appear to be a single point of color at a distance. In the present embodiment, each pixel 302 contains a red/amber LED 310, a green LED 312, and a blue LED 314. As discussed previously, each LED array 104, 106 can implement a plurality of colors. Thus each array 104, 106 may have one or more associated panels 300 having a plurality of LED colors in each pixel and have the capability of providing a multitude of colors, intensities, and effects on each associated panel 300.

* * * *

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A lighting indicator system comprising:

a controller having an analog output signal;

an LED array receiving the analog output signal and lighting a plurality of LEDs in response, the LED array comprising an analog circuit, wherein each of the LEDs is electrically coupled with a transistor and a current limiter of the analog circuit, the transistor and the current limiter being coupled to the controller through an analog input lead, the transistor receiving the analog output signal through the analog input lead from the controller and wherein each of the plurality of LEDs produces one or more LED color colors;

wherein the LED array provides a second analog output that echoes the received analog output signal from the controller; and a second LED array that is identical to the LED array, the second LED array receiving the second analog output signal from the LED array and lighting a plurality of LEDs in response.

2. The system of claim 1, wherein the analog output signal comprises a plurality of signals indicative of a plurality of colors for selective display on the LED array.

3. The system of claim 1, wherein the controller is a programmable microcontroller.

4. A signaling system comprising:

a controller that accepts user input and provides electronic analog output signals; and a first multicolor indicator that provides a visual signal of a first color in response to a first predetermined signal from the controller, the first multicolor indicator comprising an analog circuit that comprises a plurality of pairs of transistors coupled with circuit limiters, wherein each transistor and circuit limiter pair is coupled to the controller through a dedicated analog input lead; and wherein the first multicolor indicators provides electronic analog output signals that echo the electronic analog output signals signal from the controller.

5. The signaling system of claim 4, further comprising a second multicolor indicator that receives the echoed signal from the first multicolor indicator, provides a visual signal of the first color in response to the received signal, and echoes the received signal on an electronic analog output signal.

6. The signaling system of claim 5, wherein the first and second multicolor indicators provide visual signals of a second color in response to a second predetermined signal from the controller.

7. The signaling system of claim 6, wherein the multicolor indicators comprise light emitting diodes (LED) arrays.

8. The signaling system of claim 7, wherein the LED arrays provide a plurality of LED colors.

9. The signaling system of claim 8, wherein the controller provides an electronic analog output signal corresponding to each of the plurality of LED colors to the multicolor indicators.

10. The signaling system of claim 7, wherein the LED arrays are arranged as a flat panel of individual LEDs for providing a high visibility signal to a large audience.

11. The signaling system of claim 10, wherein the LED arrays are arranged to provide racing signals to spectators at a racetrack.

12. A light emitting diode (LED) signaling system comprising:

a controller producing a plurality of analog signals; and a first LED signal panel comprising:

a first power supply;

an LED of a first color;

an LED of a second color;

a first analog input lead corresponding to the LED of the first color that receives a first color analog output signal of the plurality of analog signals from the controller;

a first transistor corresponding to the LED of the first color, coupled with the LED of the first color and the first analog input lead;

a second analog input lead corresponding to the LED of the second color that receives a second color analog signal of the plurality of analog signals;

a second transistor corresponding to the LED of the second color, coupled with the LED of the second color and the second analog input lead;

a first analog output lead corresponding to the first color; and a second analog output lead corresponding to the second color;

wherein the first LED signal panel utilizes the first power supply to drive the LED of the first color at an intensity according to the first color analog signal and to drive the LED of the second color at an intensity according to the second color analog signal; and wherein the first LED signal panel echoes the first color analog signal and the second color analog signals to the first and second analog outputs, respectively.

13. The system of claim 12, further comprising:

a controller having a power supply and being electrically connected to the first analog input lead and the second analog input lead of the first LED signal panel; and wherein the controller accepts user inputs and generates the plurality of analog signals for the first LED signal panel.

14. The system of claim 13, further comprising:

a racetrack catch fence visible to a spectator, the racetrack catch fence comprising a plurality of sections and a column disposed between adjacent ones of the plurality of sections, wherein each column disposed between the adjacent ones of the plurality of sections comprises the first LED signal panel.

15. The system of claim 14, wherein the first and second LED signal panels are capable of generating at least visible yellow and green lighting.

* * * * *